US009016516B2

(12) United States Patent
Ortenzi et al.

(10) Patent No.: US 9,016,516 B2
(45) Date of Patent: Apr. 28, 2015

(54) PEN-TYPE PHARMACEUTICAL PRODUCT DISPENSER

(75) Inventors: Vernon D. Ortenzi, Burlington, KY (US); Robert J. Ziemba, Cincinnati, OH (US); Frank M. Lewis, Fairfield, OH (US); Geoffrey S. Strobl, Williamsburg, OH (US)

(73) Assignee: Mallinckrodt LLC, Hazelwood, MO (US)

( * ) Notice: Subject to any disclaimer, the term of this patent is extended or adjusted under 35 U.S.C. 154(b) by 56 days.

(21) Appl. No.: 13/103,234

(22) Filed: May 9, 2011

(65) Prior Publication Data

US 2011/0272426 A1 Nov. 10, 2011

Related U.S. Application Data

(60) Provisional application No. 61/333,121, filed on May 10, 2010.

(51) Int. Cl.

| | |
|---|---|
| ***G07F 11/00*** | (2006.01) |
| ***B65H 1/08*** | (2006.01) |
| ***B65D 83/04*** | (2006.01) |
| ***A61J 7/00*** | (2006.01) |
| ***A61J 7/04*** | (2006.01) |
| *A61J 1/03* | (2006.01) |

(52) U.S. Cl.

CPC ..... *B65D 83/04* (2013.01); *A61J 7/0076* (2013.01); *A61J 1/03* (2013.01); *A61J 7/04* (2013.01)

(58) Field of Classification Search

USPC ..... 221/4, 2, 232, 279, 198, 247, 267, 281, 221/245, 7, 69, 264, 155, 154, 25, 145 R; 206/42, 537

See application file for complete search history.

(56) References Cited

U.S. PATENT DOCUMENTS

| | | | | | |
|---|---|---|---|---|---|
| 2,587,147 | A | * | 2/1952 | Guion et al. | 116/308 |
| 2,706,464 | A | * | 4/1955 | North | 116/308 |
| 2,718,299 | A | * | 9/1955 | Atwater et al. | 206/537 |
| 2,866,433 | A | * | 12/1958 | Kallick et al. | 116/324 |
| 2,885,110 | A | * | 5/1959 | Tregilgas | 221/2 |
| 2,885,116 | A | * | 5/1959 | Tregilgas | 221/198 |
| 3,270,915 | A | * | 9/1966 | Auer | 221/2 |
| 3,365,099 | A | * | 1/1968 | Mctaggart | 221/267 |
| 3,407,962 | A | * | 10/1968 | Ragan | 221/4 |
| 3,483,845 | A | * | 12/1969 | Hartman, Jr. | 116/308 |
| 3,511,409 | A | * | 5/1970 | Huck | 221/7 |
| 3,527,190 | A | * | 9/1970 | Huck | 116/308 |

(Continued)

*Primary Examiner* — Rakesh Kumar

(74) *Attorney, Agent, or Firm* — James L. Johnson; Marsh Fischmann & Breyfogle LLP

(57) ABSTRACT

Pharmaceutical product dispensers (e.g., in the shape of a common ink pen) are operable to indicate information regarding a dosing schedule of a pharmaceutical product dispensable from the dispenser. Embodiments of the dispensers may include a plurality of dosing segments, each corresponding to a different dose of the pharmaceutical product. Actuation of an actuator may result in interaction between the actuator and the pharmaceutical product storage area such that a dose of pharmaceutical product contained in the pharmaceutical product storage area is dispensed, along with a corresponding advancement of the plurality of dosing segments. The dispenser may also include one or more locks to prevent unauthorized access to the pharmaceutical product (e.g., by a child or the like). Furthermore, the pharmaceutical product dispenser may include a disabling mechanism to permanently disable actuation of the actuator of the dispenser.

35 Claims, 4 Drawing Sheets

(56) References Cited

U.S. PATENT DOCUMENTS

| | | | | | |
|---|---|---|---|---|---|
| 3,533,371 | A | * | 10/1970 | Kutik et al. | 206/534 |
| 3,557,747 | A | * | 1/1971 | Rigney et al. | 116/308 |
| 3,612,348 | A | * | 10/1971 | Thomas | 221/2 |
| 3,687,336 | A | * | 8/1972 | Gayle | 221/7 |
| 3,688,945 | A | * | 9/1972 | Harman et al. | 221/8 |
| 3,762,539 | A | * | 10/1973 | Kerr | 206/537 |
| 3,854,625 | A | * | 12/1974 | Kuebler | 221/198 |
| 3,921,806 | A | * | 11/1975 | Wawracz | 206/534 |
| 4,094,408 | A | * | 6/1978 | Ford | 206/534 |
| 4,127,190 | A | * | 11/1978 | Sunnen | 206/535 |
| 4,223,801 | A | * | 9/1980 | Carlson | 221/3 |
| 4,742,936 | A | * | 5/1988 | Rein | 221/5 |
| 4,807,757 | A | * | 2/1989 | Rappaport et al. | 206/535 |
| 5,226,895 | A | * | 7/1993 | Harris | 604/208 |
| 5,230,440 | A | | 7/1993 | Kurokawa | |
| 5,366,113 | A | * | 11/1994 | Kim et al. | 221/232 |
| 5,482,163 | A | * | 1/1996 | Hoffman | 206/534 |
| 5,645,534 | A | * | 7/1997 | Chanoch | 604/189 |
| 6,564,967 | B1 | * | 5/2003 | Stringfield et al. | 221/229 |
| 6,889,869 | B2 | * | 5/2005 | Hallin | 221/223 |
| 7,661,384 | B2 | * | 2/2010 | Mataya | 116/311 |
| 8,327,847 | B2 | * | 12/2012 | Scarrott | 128/205.23 |
| 2008/0257851 | A1 | * | 10/2008 | Vargas | 215/230 |
| 2011/0272426 | A1 | * | 11/2011 | Ortenzi et al. | 221/2 |

* cited by examiner

PEN-TYPE PHARMACEUTICAL PRODUCT DISPENSER

CROSS REFERENCE TO RELATED APPLICATIONS

This patent application claims priority to U.S. Provisional Patent Application Ser. No. 61/333,121, entitled "PEN-TYPE PHARMACEUTICAL PRODUCT DISPENSER," and filed on May 10, 2010.

FIELD

The present invention is generally related to pharmaceutical product dispensers.

BACKGROUND

The safety and effectiveness of many pharmaceutical products are strongly affected by the dosing schedule for the pharmaceutical product. The prescribed time periods for taking a pharmaceutical product may affect the concentration of the pharmaceutical product and/or the amount of pharmaceutical product in the patient. The administration of too much or too little of a pharmaceutical product can lead to adverse events or ineffective treatment. It is not uncommon for those taking medication to forget whether they have taken their medicine according to the appropriate dosing regimen or recommended use. This may be the result of a break in routine, confusion of multiple medications, mental disease states, simply forgetting, or the like. When this occurs, there are several unsafe scenarios that may occur.

For example, if the patient has taken their dose, forgets that they have done so, and proceeds to take a second dose, the effect may be the doubling of the prescribed dosage. This could lead to an unsafe adverse event. In another scenario, the patient may unintentionally skip a dose and may later not remember if the dose had been taken. The patient may decide not to dose again in order to avoid the adverse effects discussed above regarding doubling a dose. However, the missed dose may result in loss of effectiveness of the pharmaceutical product (e.g., in the case of an analgesic, the patient's pain resulting from a missed dose may lead to the patient's pain reaching a level that becomes difficult to manage).

Additionally, serious public health issues arise due to the abuse, misuse, diversion, and overdose of medications. Such adverse outcomes may result from unauthorized access to medication during a course of treatment or medication that remains at the end of the course of treatment. For instance, the abuse, misuse, diversion and overdose of opioid-based analgesics pose particularly pertinent public health issues given the effects and potential for abuse of opioid-based analgesics. It is often the case that after a course of treatment, or as a result of the patient not completing the full treatment, there may be excess medication remaining which should be discarded.

In many instances, individuals simply retain such unused medication. Oftentimes these medications are stored with other pharmaceutical products or the like. In turn, the risk of unintentional access (e.g., by a child) and/or unauthorized access (e.g., by an abuser) is increased. Alternatively, the medication may simply be placed in the trash or some other non-secure disposal means. In either instance, access to the medication remains, such that the medication may be abused, misused, stolen, sold, or otherwise mishandled. Unauthorized access to these improperly disposed of medications by individuals without a prescription may lead to abuse, allergic reaction, or even death.

SUMMARY

The present invention may be characterized as relating to pharmaceutical product dispensers that include an actuator that interacts with a pharmaceutical product storage area to dispense pharmaceutical product, along with a dosing indicator that interacts with the actuator. The dosing indicator may provide current dosing status information to a user (e.g., a patient) or other individual (e.g., a doctor, nurse, other caregiver, or the like). The present invention may include dispensers that generally take the form of common ink pens (e.g., a push-button retracting ink pen). The dosing indicator may be responsive to the actuator to reflect a change in the dosing status information upon actuation of the actuator. In turn, the pharmaceutical product dispensers may reduce the potential for misuse of a pharmaceutical product.

A number of aspects of the present invention utilize what may be characterized as a first combination—a pharmaceutical product dispenser having an elongated housing, an actuator, and a dosing indicator. The elongated housing includes a pharmaceutical product storage area for storing a pharmaceutical product. The actuator interacts with the pharmaceutical product storage area in order to dispense pharmaceutical product from the dispenser (e.g., when pharmaceutical product is loaded into the dispenser, which is not required unless otherwise noted in a given circumstance). Additionally, the dosing indicator is operatively interconnected with the actuator (e.g., such that the actuator may change the dosing indicator upon actuation of the actuator, for instance to reflect a change in the dosing status information).

A first aspect of the present invention is in the form of the above-noted first combination, along with an actuator lock. A first motion of the actuator dispenses a dose from the pharmaceutical product storage area. A second motion of the actuator changes the actuator lock between a locked configuration and an unlocked configuration with respect to the actuator. The noted first and second motions of the actuator are of a different type.

A second aspect of the present invention is in the form of the above-noted first combination, along with a dispenser lock and an actuating mechanism. This actuating mechanism is operatively interconnected with the dispenser lock, and furthermore is spaced from the actuator. The actuating mechanism and the actuator are positioned relative to one another so as to require one hand to interface with the actuating mechanism of the dispenser lock and the other hand to interface with the actuator.

A third aspect of the present invention is in the form of the above-noted first combination, where the dosing indicator includes a plurality of dosing segments. Adjacent dosing segments are sequentially advanced (by actuation of the actuator) into alignment with the respective ones of first dosing information and second dosing information associated with the dispenser.

A fourth aspect of the present invention is in the form of the above-noted first combination, where the actuator is disposed on a first end of the elongated housing and pharmaceutical product is dispensed from a second end of the elongated housing. These first and second ends are opposite of one another.

A fifth aspect of the present invention is in the form of the above-noted first combination, along with a heat activated encapsulation material. Heat activation of the heat-activated encapsulation material changes the pharmaceutical product dispenser from dispensing mode (e.g., where pharmaceutical product may be dispensed from the pharmaceutical product storage area in the intended fashion) to a non-dispensing mode (e.g., where pharmaceutical product is unable to be dispensed from the pharmaceutical product storage area in the intended fashion).

A number of feature refinements and additional features are separately applicable to each of the above-noted first, second, third, fourth, and fifth aspects of the present invention. These feature refinements and additional features may be used individually or in any combination by each of the above-noted first, second, third, fourth, and fifth aspects of the present invention. As such, each of the following features that will be discussed may be, but are not required to be, used with any other feature or combination of features of any one or more of the above-noted first, second, third, fourth, and fifth aspects of the present invention. Initially, each of the first, second, third, fourth, and fifth aspects of the present invention may be used together in any combination (e.g., the first aspect may utilize one or more of the second, third, fourth, and fifth aspects of the present invention).

The pharmaceutical product dispenser may be a pen-style pharmaceutical product dispenser. In this regard, the dispenser may have a size, shape, and/or profile similar to that of a common ink pen. For instance, the elongated housing may be approximately the same length and have approximately the same diameter as common ink pens. In one embodiment, the elongated housing is cylindrical (e.g., in the form of a hollow tube). In any case, the elongated housing may include a sidewall. The sidewall may at least partially define the pharmaceutical storage area. The dimension in which the dispenser housing is elongated may define a maximum or largest dimension of the dispenser housing.

The sidewall of the elongated housing may include a window, or a plurality of window segments, such that an interior portion of the elongated housing may be visible from an exterior of the dispenser. The window may accommodate a visual indication of how many doses have been dispensed. Additionally, the window may accommodate a visual indication of how many doses remain in the dispenser. Further still, the window may accommodate both a visual indication of how many doses have been dispensed and how many doses remain in the dispenser. The window may allow for viewing of at least a portion of the pharmaceutical product storage area from an exterior of the dispenser. In various embodiments, the window may provide visual access to an entirety of the pharmaceutical product storage area. Additionally, at least a portion of the dosing indicator may be viewable through the window. The dosing indicator may be located within the pharmaceutical product storage area such that when viewing the pharmaceutical storage area, at least a portion of the dosage indicator is also visible. Alternatively, the dosing indicator may be provided separately from the pharmaceutical product storage area such that the dosing indicator and pharmaceutical product storage area are separately viewable from an exterior of the dispenser.

The actuator may be accessible from an exterior of the dispenser so that a user/patient may manipulate the actuator. For instance, the actuator may be disposed at a first end of the elongated housing. Pharmaceutical product may be dispensed from a second end of the elongated housing that is opposite of the actuator. Alternatively, the actuator may be disposed on a sidewall of the elongated housing (e.g., between opposing ends of the dispenser). The actuator may be operative to interact with the pharmaceutical storage area to dispense pharmaceutical product upon actuation of the actuator. For example, one actuation of the actuator may dispense a single dose from the elongated housing. Each actuation of the actuator may dispense a single dose from the elongated housing. Additionally, movement of the actuator may affect (e.g., cause movement of) the dosing indicator. Each actuation of the actuator may advance the dosing indicator one increment. In turn, the advancement of the dosing indicator may result in changed or updated dosing status information being displayed by the dosing indicator.

The actuator may include an actuator lock. The actuator lock may be used to reduce the potential that pharmaceutical product is dispensed in error from the dispenser. The actuator lock may lock the actuator (e.g., reversibly disable the actuator) to selectively prevent actuation of the actuator. In this regard, different motions of the actuator may result in different outcomes. For instance, a first motion of the actuator may dispense a dose from the pharmaceutical product storage area, while a second motion of the actuator may change the actuator lock between an unlocked configuration and a locked configuration. The first and second motions may be of a different type. The first motion may be an axial movement of the actuator (e.g., in either direction along an axis), and the second motion may be a rotational movement of the actuator (e.g., a motion in any direction about a certain axis, for instance the long axis of the dispenser). When the actuator lock is in the locked configuration, the actuator lock may prevent actuation of the actuator (a locked state for the actuator). In contrast, when the actuator lock is in the unlocked configuration, the actuator lock may allow for actuation of the actuator (an unlocked state for the actuator).

The actuator lock may provide for permanent locking/disabling of the actuator. In this regard, the actuator may be movable into a position where the actuator lock permanently locks/disables the actuator. The actuator may be moved in a first direction to dispense a dose from the pharmaceutical product storage area; the actuator may be moved in a second direction, from a locked position to an unlocked position, to selectively change the actuator lock from a locked configuration to an unlocked configuration, for instance to allow the actuator to be moved in the first direction; and the actuator may be moved in a third direction, from the locked position to a disposal position, to permanently lock/disable the actuator, where the first, second, and third directions are different from one another. In one embodiment, the first direction is along an axial path, the second direction (from the locked position to the unlocked position) is one of clockwise or counterclockwise about a long axis of the actuator, and the third direction (from the locked position to the disposal position) is the other of clockwise or counterclockwise about a long axis of the actuator. The permanent locking of the actuator (or the positioning of the actuator in the disposal position) would allow for safer disposal of a dispenser containing left-over pills after a patient no longer requires the medication.

In one embodiment, the dosing indicator may provide a visual indication of a number of doses that have been dispensed from the pharmaceutical product dispenser. In this regard, the dosing indicator may have a plurality of dosing segments that are sequentially advanced by actuation of the actuator. When advanced, the dosing segments of the dosing indicator may display updated or changed dosing schedule information. For instance, advancement of the dosing segments may result in alignment of the dosing segments with dosing information (e.g., provided on the elongated housing). The dosing information may be textual information (or other types of information) that corresponds to the last dose that was dispensed or textual information (or other types of information) that corresponds to the next dose that is to be dispensed. Alternatively, first and second dosing information may be provided with the dispenser (e.g., on the elongated housing), such that multiple dosing segments may be alignable with the first and second dosing information to convey at least two portions of information. For instance, the at least two portions of information may include a retrospective component (e.g., corresponding with the last dose that was dispensed) and a prospective component (e.g., corresponding with the next dose that is to be dispensed). The dosing indicator may have a plurality of dosing segments such that adjacent pairs of dosing segments may be sequentially advanced into alignment with the first dosing information and the second dosing information by actuation of the actuator. In any case, the dosing indicator may be axially advanced by actuation of the actuator. Alternatively, the dosing indicator may be rotationally advanced by actuation of the actuator.

The elongated housing may include first and second windows, or first and second window segments. The housing may incorporate explanatory information (e.g., first and/or second dosing information next to the first and/or second window segments, respectively, to convey that a dosing segment appearing in the first window corresponds with a next dose to be dispensed and/or that dosing segments appearing in the second window correspond to doses that have been dispensed). Each respective dosing segment may comprise indicia (e.g., a checkmark icon) which when displayed may convey that a dose corresponding to the dosing segment was dispensed. In one embodiment, the indicia on each respective dosing segment may be viewable when the respective dosing segment is in the second window, but not when the respective dosing segment is in the first window. In turn, a dosing segment may first appear in the first window (e.g., upon one actuation), and thereafter be advanced into the second window (e.g., upon a subsequent actuation). When the dosing segment appears in the second window, the indicia of the respective dosing segment (e.g., a checkmark) may be displayed, which may indicate that a corresponding dose was dispensed. All dosing segments that correspond with doses that have been dispensed may simultaneously appear in the second window, which may also provide information on the total number of doses that have been dispensed. The order in which the dosing segments appear in the second window may correspond to the order in which the doses were dispensed.

The dispenser may also include a dispenser lock and an actuating mechanism (e.g., the pharmaceutical product dispenser may utilize two different locks—an actuator lock and a dispenser lock). The actuating mechanism for the dispenser lock may be spaced from the actuator, and furthermore may be operatively interconnected with the dispenser lock. The actuating mechanism may be positioned relative to the actuator so as to require one hand to interface with the actuating mechanism for the dispenser lock and another hand to interface with the actuator. In one embodiment, the actuating mechanism of the dispenser lock may need to be engaged in order to actuate the actuator. That is, actuation of the actuator may be at least partially dependent on engagement of the actuating mechanism for the dispenser lock. The dispenser lock may be operatively connected with a discharge opening cover, such that the discharge opening cover must be moved to allow the pharmaceutical product to be discharged from the pharmaceutical product storage area. The operation of the dispenser lock or its use in conjunction with the actuator may provide child resistant elements to the dispenser.

The dispenser may have pharmaceutical product within the pharmaceutical product storage area. The pharmaceutical product may be arranged such that individual doses of the pharmaceutical product are aligned in a row. As such, pharmaceutical product may be linearly arranged (e.g., within a stack). All remaining pharmaceutical product within the dispenser may be viewable from an exterior of the dispenser (e.g., through a window in which at least part of the dosing indicator may also be viewable).

The pharmaceutical product dispenser may include a disabling mechanism. The disabling mechanism may be operative to permanently reduce the likelihood that pharmaceutical product can be dispensed from the pharmaceutical product dispenser by actuation of the actuator. In one particular embodiment, the disabling mechanism may comprise at least a portion of the actuator. The actuator may be moveable into a position where the disabling member permanently disables the actuator (e., the above-noted disposal position). For instance, a certain movement of the actuator may result in the disabling member acting (e.g., by breaking, bending, rupturing, wedging, or otherwise acting on a member, being acted on by a member, or the like) to permanently disable the dispenser.

The pharmaceutical product dispenser may include a heat-activated encapsulation material. Generally, heat activation of the heat-activated encapsulation material may be characterized as changing the pharmaceutical product dispenser from a dispensing mode to a non-dispensing mode. The dosing indicator may be made of the heat-activated encapsulation material. The elongated housing may have a first melting temperature, and the heat-activated encapsulation material may have a second melting temperature. Accordingly, the heat-activated encapsulation material may be heated above its melting temperature, while the housing remains below its melting temperature (i.e., the first melting temperature may be higher than the second melting temperature). Heat activation of the heat-activated encapsulation material may lock or permanently restrict access to the pharmaceutical product storage area. Heat activation of the heat-activated encapsulation material may physically encapsulate pharmaceutical product within the heat-activated encapsulation material (e.g., after cooling). That is, heating the dispenser to at least the second melting temperature (e.g., a temperature between the first and second melting temperatures) may activate the encapsulation material (e.g., allow the encapsulation material to melt) so as to at least partially encapsulate the pharmaceutical product.

The heat-activated encapsulation material may be incorporated by or integrated with the pharmaceutical product dispenser in any appropriate manner and at any appropriate location or combination of locations. In one embodiment, the heat-activated encapsulation material is spaced from the pharmaceutical product until it has been heat-activated. Another embodiment has the heat-activated encapsulation material in contact with the pharmaceutical product even prior to its activation. In any case, the heat-activated encapsulation material should not have an adverse effect on the pharmaceutical product prior to its activation. In one embodiment, the melting temperature of the heat-activated encapsulation material is less than the melting temperature of the elongated housing such that the integrity of the elongated housing is not compromised during the encapsulation process.

The heat-activated encapsulation material is subject to a number of other characterizations. For instance, the heat-activated encapsulation material may be in the form of one or more "encapsulation components" operable to at least partially or fully encase or encapsulate the pharmaceutical product, to disable the actuator (e.g., fix or bond the actuator so as to at least impede any further actuation), or both, all so as to reduce the potential that the pharmaceutical component will thereafter be dispensable from the dispenser. Further still, the heat-activated encapsulation material may disable (e.g., fix or bond) the dispenser lock. For instance, the discharge opening cover may be rendered inoperable (e.g., unopenable or immovable) by the heat-activated encapsulation material.

Non-limiting examples for the heat-activated encapsulation material include without limitation plastic, wax, adhesive, combinations thereof, and the like, which may be in any appropriate form such as layers, sleeves, etc. In one embodiment, heating the dispenser to at least the second melting temperature activates the heat-activated material without melting the elongated housing. Use of the phrase "encapsulation component" herein also contemplates use of more than a single encapsulation component.

The heat-activated encapsulation material may be disposable within the dispenser (e.g., within the pharmaceutical product storage area) or otherwise have access to the pharmaceutical product in any appropriate manner. In an embodiment, the heat-activated encapsulation material may be disposed within the pharmaceutical product storage area. For instance, the heat-activated encapsulation material may be appropriately bonded or otherwise attached to an inside surface of the pharmaceutical product storage area (e.g., via adhesives, as part of the manufacturing process, or the like). As another example, the heat-activated encapsulation material may comprise the dosing indicator. For instance, the dosage indicator may be constructed of the heat-activated encapsulation material. In an embodiment, the heat-activated encapsulation material may be in the form of a sleeve that may be inserted into or otherwise disposed within the storage area, and furthermore may be bonded to the inside surface of the storage area.

In an embodiment, any appropriate heating source (e.g., microwave oven, conventional oven, or the like) may be utilized to heat the dispenser to at least a melting temperature of the heat-activated encapsulation material. In an arrangement, the dispenser is not heated to its melting temperature (e.g., to maintain or otherwise reduce degradation of the structural integrity of the dispenser so that the dispenser does not melt while activating the heat-activated encapsulation material). In another arrangement, the heat-activated encapsulation material may be allowed to contact the pharmaceutical product. For instance, the heating may allow the heat-activated encapsulation material to melt and drip and/or flow onto the pharmaceutical product. As another example, the heating may allow the heat-activated encapsulation material to at least partially encapsulate the pharmaceutical product or otherwise at least partially surround the pharmaceutical product.

In another arrangement, and after any of the above steps of allowing the heat-activated encapsulation material to melt, drip, flow, contact and/or encapsulate the pharmaceutical product, the heat-activated encapsulation material may be allowed to solidify on and/or around the pharmaceutical product. In this regard, the potential for administering the pharmaceutical product to an individual may be reduced as it now may be at least partially encased within a "blob" of plastic or other material making up the solidified heat-activated encapsulation material.

Activating the heat-activated encapsulation material may include inducing a change in state or phase of the heat-activated encapsulation material. For instance, the ability of the heat-activated encapsulation material to flow may be increased (i.e., the viscosity of the heat-activated encapsulation material may be lowered) by heating the dispenser. The encapsulation material may be a solid at room temperature, and in response to the heating of the dispenser the encapsulation material may change to a liquid or liquid-like state or phase. Heating the dispenser may cause the encapsulation material to melt. Upon cooling, the heat-activated encapsulation material may return to a solid phase.

The encapsulation of the pharmaceutical product within the dispenser in response to activation of the encapsulation material, which in turn is in response to heating the dispenser, may be of one or more forms. For instance, this encapsulation may entail fixedly sealing the dispenser (e.g., with unused pharmaceutical product therein), may entail disabling the actuator, may entail disabling an actuator lock, may entail disabling a dispenser lock, may entail disabling a discharge cover opening, may entail having an encapsulation material come into contact with the pharmaceutical product (including where the pharmaceutical product is at least substantially encased within the encapsulation material), may entail having an encapsulation material bond to the pharmaceutical product, may entail having the encapsulation material bond to the dispenser, or any combination thereof.

A sixth aspect of the present invention is embodied by a pharmaceutical product dispenser that includes an elongated housing, an actuator, and pharmaceutical product. The elongated housing includes a pharmaceutical product storage area. The actuator interacts with the pharmaceutical product storage area in order to dispense pharmaceutical product from the dispenser. In this regard, the pharmaceutical product may be in the form of a stack within the pharmaceutical product storage area. The sixth aspect also includes an actuator lock. The actuator lock is in operative communication with the actuator to change the actuator between a locked state and an unlocked state. When in the locked state, the actuator lock may prevent actuation of the actuator. When in the unlocked state, the actuator lock may allow actuation of the actuator.

This sixth aspect of the present invention may incorporate any one or more of the features discussed above with regard to the first through fifth aspects or any of the additional features or feature refinements discussed with respect to the first through fifth aspects, individually or in any combination. Furthermore, pharmaceutical product may be sequentially discharged from an end of the stack per each use of the actuator. The pharmaceutical product stack may extend in a common dimension in which the dispenser housing is elongated (e.g., the housing may be in the form of a cylindrical tube or the like, and the stack of pharmaceutical product may extend along this tube).

A seventh aspect of the present invention is embodied by a pharmaceutical product dispenser that includes an elongated housing, an actuator, and a window. The elongated housing includes a pharmaceutical product storage area, and is elongated in a first dimension. The pharmaceutical product storage area extends along the first dimension of the dispenser housing (e.g., to accommodate a stack of pharmaceutical product). The actuator interacts with the pharmaceutical product storage area in order to dispense pharmaceutical product from the dispenser (e.g., when pharmaceutical product is loaded into the dispenser, which is not required by the seventh aspect). The window is provided in the dispenser housing, and extends along the entire extent of the pharmaceutical product storage area (e.g., to accommodate viewing of pharmaceutical product that remains within the pharmaceutical product storage area). Additionally, a disabling member is in operative communication with at least one of the actuator and the pharmaceutical product storage area. The disabling member may be activated to permanently disable the dispenser to reduce the potential for dispensing of a pharmaceutical product from the dispenser after activation of the disabling member.

This seventh aspect of the present invention may incorporate any one or more of the features discussed above with regard to any one or more of the first through sixth aspects or any of the additional features or feature refinements discussed with respect to the first through sixth aspects, individually or in any combination. Any one or more of the features of the seventh aspect may be used by one or more of the above-discussed aspects as well, individually or in any combination.

A number of feature refinements and additional features are applicable to each of the first, second, third, fourth, fifth, sixth, and seventh aspects of the present invention. These feature refinements and additional features may be used individually or in any combination in relation to each of the first, second, third, fourth, fifth, sixth, and seventh aspects of the present invention. As such, each of the following features that will be discussed may be, but are not required to be, used with any other feature or combination of features of the first, second, third aspects, fourth, fifth, sixth, and seventh aspects. The following discussion is separately applicable to each of the first, second, third, fourth, fifth, sixth, and seventh aspects as well.

The pharmaceutical product dispenser may incorporate pharmaceutical product. A "pharmaceutical product" as used herein may generally define any material or substance used in the course of a medical treatment, medical diagnosis, therapy, or the provision of any other appropriate medical care. A given material need not contain an active drug compound or ingredient to be considered a "pharmaceutical product" for purposes of the present invention.

Any pharmaceutical product incorporated by any of the aspects of the present invention may be in any appropriate form, in any appropriate dose, and of any appropriate type. A pharmaceutical product encompasses both a single-dose configuration (e.g., a single pill) and a multiple dose configuration (e.g., a plurality of pills). Pharmaceutical product may be in any appropriate form such as (but not limited to) pills, tablets, chewables, capsules, or the like. Further, a "pharmaceutical product" may refer to or include any "drug" as defined in Title 21 of the United States Code, Section 321(g)(1).

Any feature of any other various aspects of the present invention that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular (e.g., indicating that a pharmaceutical product dispenser includes "a window" alone does not mean that the pharmaceutical product dispenser includes only a single window). Moreover, any failure to use phrases such as "at least one" also does not limit the corresponding feature to the singular (e.g., indicating that a pharmaceutical product dispenser includes "a window" alone does not mean that the pharmaceutical product dispenser includes only a single window). Use of the phrase "at least generally" or the like in relation to a particular feature encompasses the corresponding characteristic and insubstantial variations thereof (e.g., indicating that an elongated housing is at least generally cylindrical encompasses the elongated housing being cylindrical). Finally, a reference of a feature in conjunction with the phrase "in one embodiment" does not limit the use of the feature to a single embodiment.

DETAILED DESCRIPTION

Various embodiments of pharmaceutical product dispensers will be described in relation to the accompanying figures. A pharmaceutical product dispenser with pharmaceutical product therein may be referred to as a "pharmaceutical product supply." In any case, these pharmaceutical product dispensers are configured to store "pharmaceutical product" as described herein (e.g., in any appropriate form, in any appropriate dose, and of any appropriate type), and furthermore facilitate dispensing of a dose of pharmaceutical product in response to actuation of an actuator. The pharmaceutical product container may include a dosing indicator that is also responsive to actuation of the actuator, and is operable to provide dosing schedule information (e.g., to reduce the potential for errors with dosing schedules for a pharmaceutical product contained by the pharmaceutical product containers described herein).

Figure 1:
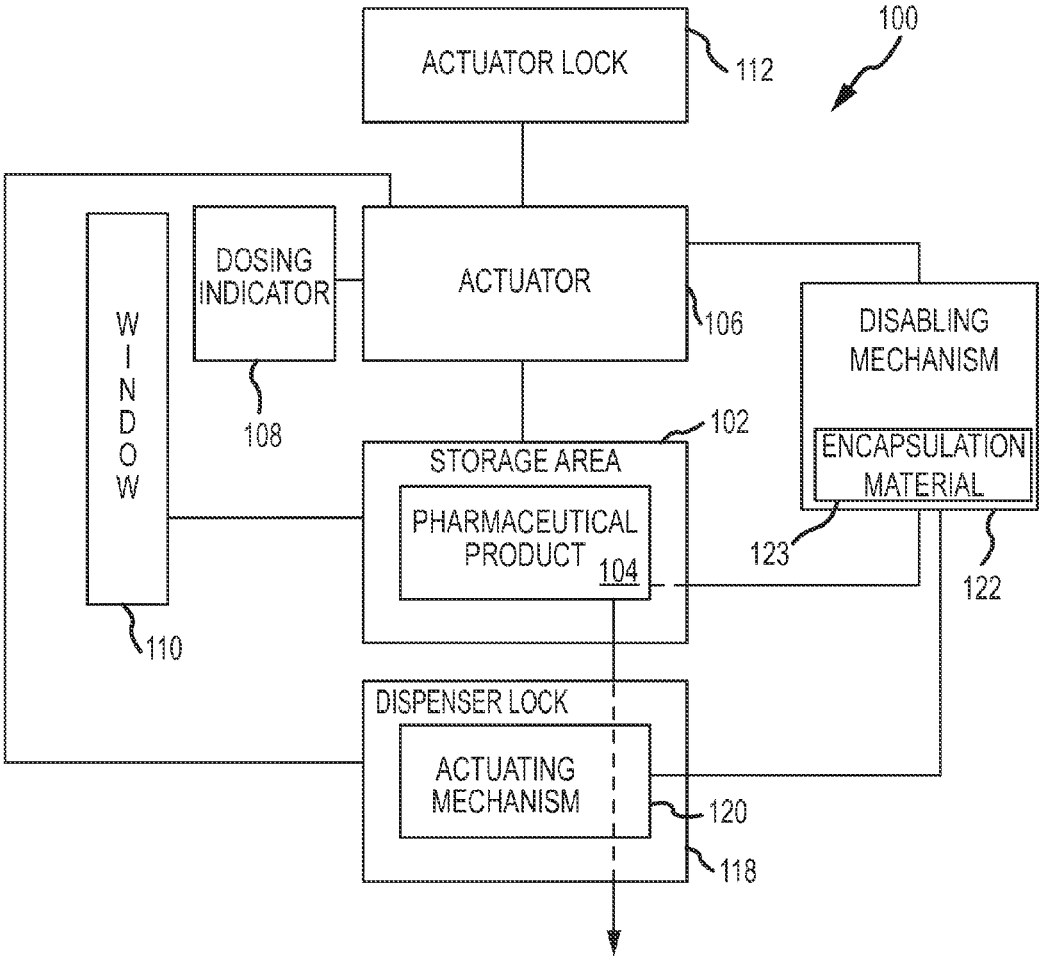
FIG. 1 is a schematic view of an embodiment of a pharmaceutical product dispenser.

With reference to FIG. 1, a schematic view of a pharmaceutical product dispenser 100 is shown. The product dispenser 100 may take various forms, and may be of any appropriate size, shape, configuration, and/or type. For instance, the dispenser 100 may have a similar shape as that of a common ink pen. The dispenser 100 may include a pharmaceutical product storage area 102. Pharmaceutical product 104 may be disposed in the pharmaceutical product storage area 102. The storage area 102 may isolate pharmaceutical product 104 from an exterior of the dispenser 100 so that the pharmaceutical product 104 is enclosed within the storage area 102, and access thereto may be limited by the storage area 102. The pharmaceutical product 104 may be arranged linearly within the pharmaceutical product storage area 102. For instance, the pharmaceutical product 104 may be aligned in a row or stacked within the storage area 102 (e.g., in end-to-end relation).

The pharmaceutical product storage area 102 may be in operative communication with an actuator 106. The actuator 106 may be operative to interact with the storage area 102 in order to selectively dispense pharmaceutical product 104 from storage area 102. A single actuation of the actuator 106 may result in a single dose of pharmaceutical product 104 being dispensed from the storage area 102. In this regard, a single dose of pharmaceutical product 104 may be dispensed from the storage area 102 upon each successive actuation of the actuator 106 until no pharmaceutical product 104 remains within the storage area 102 or the pharmaceutical product dispenser 100 is otherwise disabled (discussed below). While a single dose may correspond to a single unit of pharmaceutical product 104 (e.g., a single pill, tablet, capsule, etc.), this is not necessary and embodiments of the dispenser 100 may include those where a plurality of units of pharmaceutical products 104 (e.g., a plurality of pills, tablets, capsules, etc.) comprise a single dose. Thus, a plurality of units of pharmaceutical product 104 may be dispensed with each actuation of the actuator 106.

The actuator 106 may be incorporated by the pharmaceutical product dispenser 100 such that the user has access to the actuator 106 from an exterior of the dispenser 100. For instance, the actuator 106 may be disposed at an end of the dispenser 100 or may be disposed on a sidewall of the dispenser housing as will be discussed further below. The actuator 106 may include any appropriate device that can be manipulated by a user to actuate the actuator 106. For example, the actuator 106 may include a button, slide, switch, dial, or other appropriate device to initiate or accomplish actuation of the actuator 106. In this regard, manipulation of the actuator 106 may include pushing, pulling, twisting, turning, sliding, or otherwise manipulating the actuator 106 in order to effectuate actuation.

The dispenser 100 may also include a dosing indicator 108. The dosing indicator 108 may be operatively engaged with the actuator 106 such that actuation of the actuator 106 may result in a change of the dosing indicator 108 to display changed dosing status upon actuation of the actuator 106. Actuation of the actuator 106 may coincide with the dispensing of a dose of pharmaceutical product 104 and a change to the dosing indicator 108 to reflect that a dose was dispensed.

The dosing indicator 108 may provide retrospective and/or prospective information regarding the dosing status of the pharmaceutical product 104. For instance, the dosing indicator 108 may provide a visual indication of how many doses have been taken. Additionally, the dosing indicator 108 may provide a visual indication of how many doses remain in the storage area 102. Further still, the dosing indicator 108 may provide an indication of the last time a dose was taken. Also, the dosing indicator 108 may provide indication of the next time a dose is to be taken. It will be understood that any of these forms of dosing status information, including any combination thereof, may be utilized by the dispenser 100.

The dispenser 100 may also include a window 110. The window 110 may be provided on a sidewall of the dispenser 100 (e.g., the window 110 may define a portion of the sidewall) such that at least a portion or the entirety of the storage area 102 may be visible from an exterior of the dispenser 100. Visual access may be provided by the window 110 such that the dosing indicator 108, the storage area 102, or both may be viewed through the window 110. The number of remaining doses, the number of doses that have been dispensed, or both may be viewed/determined by looking through the window 110. The window 110 may also comprise one or more window segments, which will be discussed in greater detail below.

The dispenser 100 may also have dosing information provided on the elongated housing. For instance, the dosing information may provide meaning or context to dosage status information displayed by the dosing indicator 108 (e.g., through the window 110). For instance, the dosing information may coordinate with the dosing indicator 108 to display dosing status information. In potential embodiments, the dosing information may be coordinated with the dosing indicator 108 to indicate when the next dose is due, when the last dose was dispensed, which doses have been dispensed, or any combination thereof.

Additionally, the dispenser 100 may include an actuator lock 112 that may interact with the actuator 106 to selectively prevent the actuator 106 from being actuated. That is, the actuator lock 112 may attempt to prevent the actuator 106 from being actuated accidentally or by one without authorization (e.g. by a child or abuser). In this regard, the actuator lock 112 may be selectively changed between a locked configuration and unlocked configuration to lock and unlock, respectively, the actuator 106 (e.g., to dispose the actuator 105 in locked and unlocked states). In this regard, when the actuator lock 112 is in its locked configuration, the actuator lock 112 may prevent actuation of the actuator 106. Conversely, when the actuator lock 112 is in its unlocked configuration, the actuator lock 112 may allow actuation of the actuator 106. Accordingly, when the actuator lock 112 is in the unlocked configuration, the actuator 106 may be actuated to dispense pharmaceutical product 104 out of the dispenser 100. As an example, movement of the actuator 106 in a first dimension (e.g., axial) may result in actuation of the actuator 106, while movement of the actuator 106 in a second dimension (e.g., rotational) may result in the actuator lock 112 being changed from its locked configuration to its unlocked configuration. In one embodiment, motion of the actuator 106 along a first axis (e.g., along the long axis of the actuator 106) is used to dispense pharmaceutical product 104 out of the dispenser 100, rotating the actuator 106 in a first direction (about this first axis, from a locked position for the actuator 106, and to an unlocked position for the actuator 106) is used to change the actuator lock 112 from a locked configuration to an unlocked configuration, and rotating the actuator 106 in a second direction (about this first axis, from the unlocked position for the actuator 106, to the locked position for the actuator 106), is used to change the actuator lock 112 from an unlocked configuration to a locked configuration.

The actuator lock 112 may be in the form of what is commonly referred to a "childproof safety device" such that the actuator lock 112 requires dexterity and/or strength more typical of an adult in order to overcome the actuator lock 112 to facilitate actuation of the actuator 106. In one example, the actuator lock 112 may require that a portion of the actuator 106 be turned prior to being actuated in order for proper operation of the actuator 106. Other known means of selective locking may be employed that, for instance, employ high forces, large spacings, or complex motions to prevent unwanted or unauthorized actuation of the actuator 106.

Additionally, the actuator lock 112 may be utilized to attempt to prevent any further actuation of the actuator 106. In this regard, the actuator lock 112 may be engaged upon the completion or termination of a dosing regimen such that any remaining pharmaceutical product 104 in the storage area 102 may be secured therein by substantially preventing any further actuation of the actuator 106. In one example, a specific motion of the actuator 106 may fracture or break a portion of the actuator 106 such that subsequent attempts to actuate the actuator 106 are ineffective to dispense a dose from the pharmaceutical product storage area 102. Further still, the dispenser 100 may include a dispenser lock 118 and an associated actuating mechanism 120. The dispenser lock 118 may coordinate with the actuator 106, yet its actuating mechanism 120 may be spaced apart from the actuator 106. In one embodiment, the actuating mechanism 120 and the actuator 106 may have to be actuated in concert or in a particular sequence in order to facilitate dispensing of a dose from the pharmaceutical product storage area 102. For instance, the actuating mechanism 120 may be located on the dispenser 100 at a position generally spaced apart from the actuator 106 such that the user may be required to use a first hand to actuate the actuating mechanism 120 and may be required to use a second hand to actuate the actuator 106. In one example, the dispenser lock 118 may include a sliding lock that must be depressed and held with one hand while the actuator 106 is actuated with the other hand of the user. As such, the dispenser lock 118 may require that the operator use two hands to effectuate dispensing a dose from the pharmaceutical product storage area 102. This may prevent unintended actuation of the actuator 106 or may provide a further safety feature (e.g., a child-proof lock). In another embodiment, the dispenser lock 118 may comprise a discharge opening cover over a dispensing opening of the storage area 102 such that pharmaceutical product 104 may not be dispensed from storage area 102 without actuation of the actuating mechanism 120 (e.g., which may correspond to movement of the discharge opening cover away from the dispensing opening).

Additionally, a disabling mechanism 122 may be provided with the dispenser 100. The disabling mechanism 122 may be utilized to prevent or reduce the likelihood further actuation of the actuator 106. That is, the disabling mechanism 122 may permanently disable the actuator 106. In this regard, the disabling mechanism 122 may be engaged upon the completion or termination of a dosing regimen such that any remaining pharmaceutical product 104 in the storage area 102 may be secured therein by attempting to prevent any further actuation of the actuator 106. In one example, the disabling mechanism 122 may comprise at least a portion of the actuator 106 such that a specific motion of the actuator 106 may fracture or break the disabling mechanism 122. In turn, subsequent attempts to actuate the actuator 106 may be ineffective to dispense a dose from the pharmaceutical product storage area 102. Additionally or alternatively, the disabling mechanism 122 may include an encapsulation material 123 that may be selectively activated to prevent further access to the remaining pharmaceutical material 104.

In one embodiment, the encapsulation material 123 may be a heat-activated encapsulation material that physically encapsulates the remaining pharmaceutical product 104 in the storage area 102. Alternatively or additionally, encapsulation material 123 may also be operative to render the actuator 106 ineffective. For instance, in the case where the actuator 106 is in the form of a button, encapsulation material 123 may fuse the button such that the button may not be depressed or moved so as to attempt to prevent subsequent actuation of the actuator 106. Further still, the encapsulation material 123 could render the dispenser lock 118 inoperable. For instance, in the case where dispenser lock 118 includes a cover over a dispensing opening, the encapsulation material 123 may fuse the cover to the dispenser 100 so that pharmaceutical product 104 cannot be dispensed from the dispenser 100.

Figure 2:
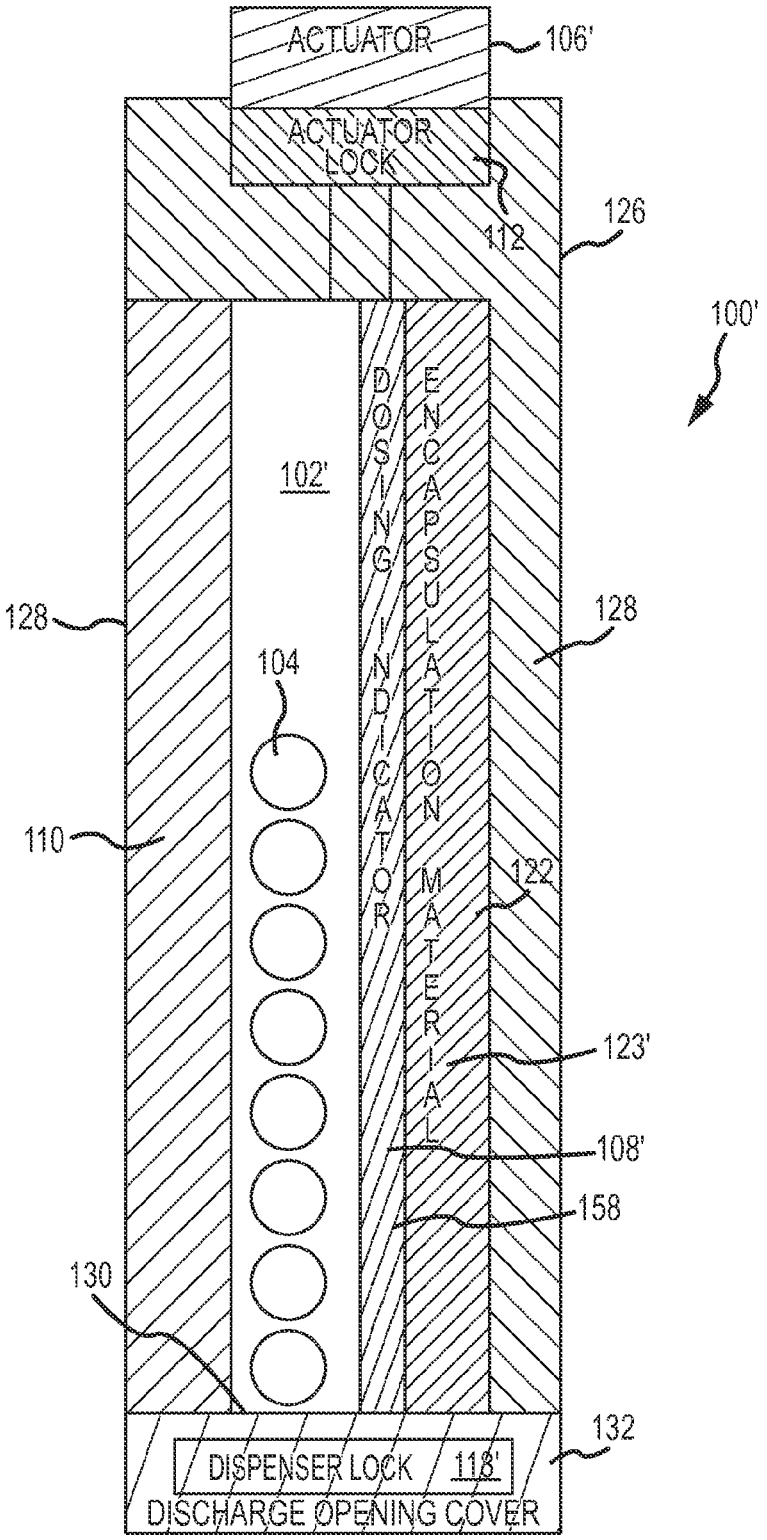
FIG. 2 is a schematic cross-sectional view of another embodiment of a pharmaceutical product dispenser.

Another embodiment of a pharmaceutical product dispenser is presented in FIG. 2 in the form of a pharmaceutical dispenser 100'. Corresponding components between the embodiments of FIGS. 1 and 2 are identified by the same reference numerals. Those corresponding components that differ in at least some respect from the embodiment of FIG. 1 are identified by a single prime designation in FIG. 2. Unless otherwise noted herein, the discussion presented with regard to the embodiment of FIG. 1 remains equally applicable to the embodiment of FIG. 2 (including in relation to each of the individual components thereof).

The dispenser 100' may include an elongated housing 126. For instance, the elongated housing 126 may have a shape, size, and/or profile similar to that of a common ink pen (e.g., a push-button retracting pen). In one embodiment, the elongated housing 126 may be at least generally cylindrical or in the form of a tube. The elongated housing 126 may include a sidewall 128. At least a portion of the sidewall 128 may include a window 110. The sidewall 128 including the window 110 may collectively define a storage area 102' in which pharmaceutical product 104 may be disposed. A discharge opening 130 may be provided such that pharmaceutical product 104 passes through the discharge opening 130 upon actuation of the actuator 106'. A discharge opening cover 132 may be provided with a dispenser lock 118'.

The pharmaceutical product dispenser 100' may also include an actuator lock 112 that is operable to dispose the actuator 106' between a locked and unlocked state. In one embodiment, the dispenser lock 118' may coordinate with the actuator 100' or actuator lock 112 to prevent unauthorized or unintentional actuation as described above (e.g., the dispenser lock 118' may control the discharge opening cover 132).

For instance, the actuator 106' and dispenser lock 118' may be generally positioned at opposite ends of the elongated housing 126 as shown in FIG. 2. Additionally, the discharge opening 130 may be provided at an end of the elongated housing 126 that is on an opposite end of the dispenser 100' as the actuator 106'. In embodiments where the actuation of the actuator 106' depends on engagement of the dispenser lock 118', the positioning of the actuator 106' and the actuating mechanism for the dispenser lock 118' at opposite ends of the elongate member 126 may require use of two hands to manipulate the spaced apart actuator 106' and actuating mechanism for the dispenser lock 118' in order to actuate the actuator 106'.

A dosing indicator 108' may be provided in the form of an indicator strip 158 that is viewable through the window 110. The indicator strip 158 may have indicia to provide dosing status information. As an example, the indicator strip 158 may be partially blocked from view by pharmaceutical product 104. In this regard, as pharmaceutical product 104 is dispensed from the dispenser 100', the indicator strip 158 may come into view such that indicia thereon may become visible. The indicator strip 158 may be a printed plastic label inserted behind the pharmaceutical product 104 on a side of the pharmaceutical product storage area 102' opposite the viewing window 110. In another embodiment, the indicator strip 158 may be advanced with the actuation of the actuator 106'. As such, the indicator strip 158 may include indicia or may coordinate with dosing information on the exterior of the dispenser 100' (e.g., on a sidewall 128 thereof) to provide explanation or further information regarding dosage status information as will be described further below.

Additionally, a disabling member 122 may be provided in the depicted embodiment of FIG. 2. For example, the disabling member 122 may comprise encapsulation material 123'. The encapsulation material 123' may also be provided in the storage area 102' such that it is generally adjacent to the pharmaceutical product 104. While shown as separate, the encapsulation material 123' and dosing indicator 108' may comprise a single structure. In this regard, the dosing indicator 108' may be constructed from the encapsulation material 123'.

Figure 3:
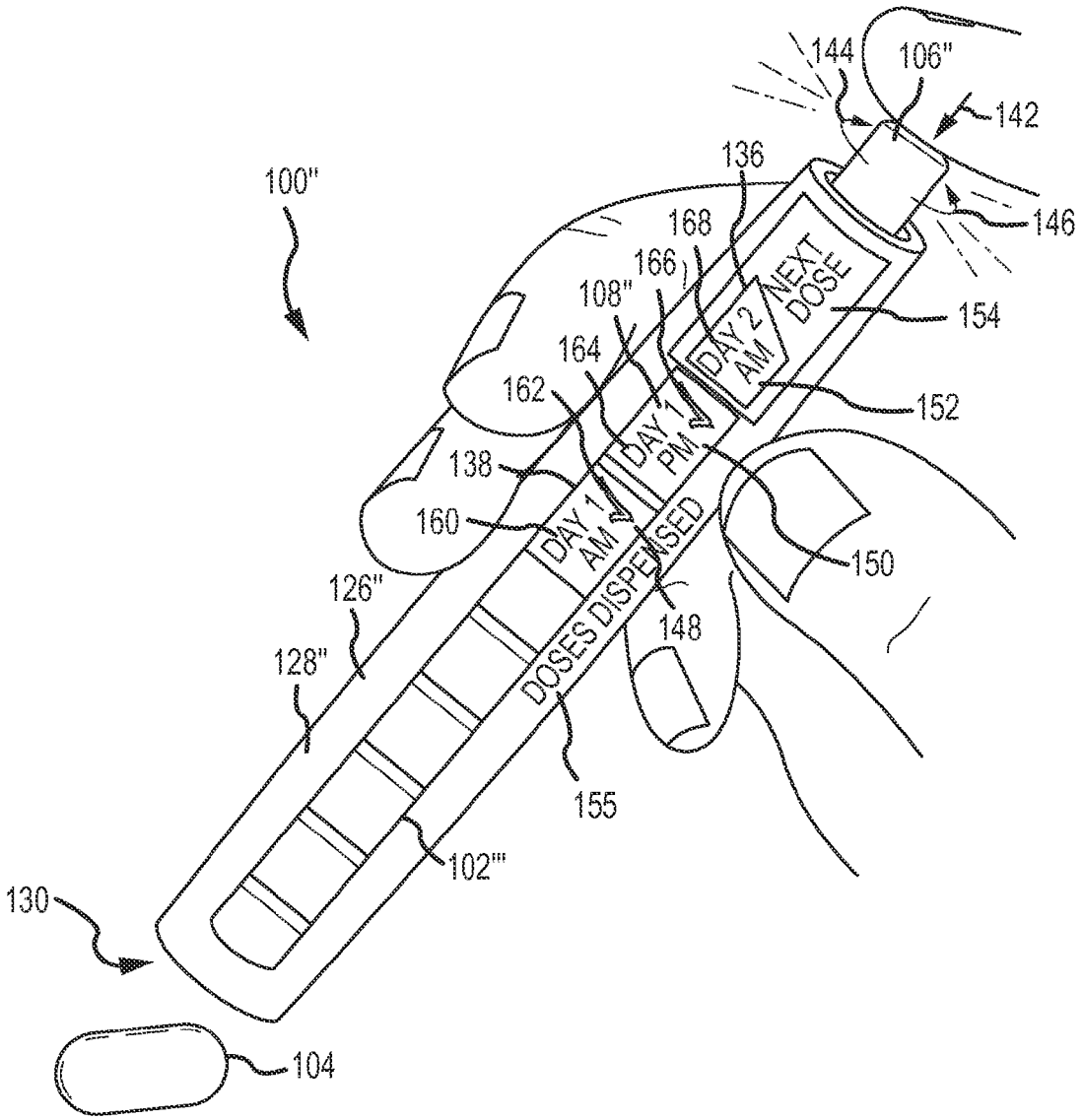
FIG. 3 is a perspective view of yet another embodiment of a pharmaceutical product dispenser.

Another embodiment of a pharmaceutical product dispenser is presented in FIG. 3 in the form of pharmaceutical product dispenser 100". Corresponding components between the embodiments of FIGS. 1, 2, and 3 are identified by the same reference numerals. Those corresponding components that differ in at least some respect from the embodiments of FIGS. 1 and 2 are identified by a double prime designation in FIG. 3. Unless otherwise noted herein, the discussion presented with regard to the embodiments of FIGS. 1 and 2 remains equally applicable to the embodiment of FIG. 3 (including in relation to each of the individual components thereof).

A dose of pharmaceutical product 104 may be dispensed from a discharge opening 130 of the dispenser 100" upon actuation of the actuator 106". Actuation of the actuator 106" may include movement of the actuator 106" in a first direction 142. As shown, the first direction 142 may generally correspond to axial movement along a longitudinal axis of the elongated housing 126" (e.g., a primary or maximum dimension of the housing 126"). The actuator 106" may be moved in a second direction 144 from a locked position (for the actuator 106") to an unlocked position (for the actuator 106") to dispose an actuator lock from a locked configuration to an unlocked configuration (to change the actuator 106" from a locked state to an unlocked state). For instance, motion in the second direction 144 from the locked position for the actuator 106" to the unlocked position for the actuator 106" may dispose the actuator 106" in the unlocked state such that the actuator 106" may be moved in the above-noted first direction 142 (e.g. depressed) without interference from an actuator lock (as it is now in its unlocked configuration). In order to again actuate the actuator 106" after having been moved in the first direction 142, the actuator 106" may again be rotated in the second direction 144 from the noted locked position for the actuator 106". That is, the actuator lock may reset (e.g., via a spring bias) upon each actuation of the actuator 106" (e.g., it may move back to the locked position for the actuator by the actuator 106" moving in a direction opposite to the second direction 144, from the unlocked position for the actuator 106" to the locked position for the actuator 106"). Also, the actuator 106" may be movable in a third direction 146 from the locked position for the actuator 106" to a disposal position for the actuator 106" (e.g., to engage a disabling mechanism as described above with regard to FIGS. 1 and 2). Motion of the actuator 106" in the third direction 146 (from the locked position for the actuator 106") may permanently lock or disable the actuator 106" such that the actuator 106" is irreversibly locked or disabled and may no longer be moved in the first direction 142 to dispense pharmaceutical product 104. For instance, motion of the actuator 106" in the third direction 146 (from the locked position for the actuator 106") may irreversibly engage the disabling mechanism to disable the actuator 106".

A first window (or window segment) 136 and a second window (or window segment) 138 may be provided in a sidewall 128" of the elongated housing 126". The first window 136 and second window 138 may be portions of a window 110 shown and described above with respect to FIGS. 1 and 2. In accord, the second window 138 may provide visual access to the storage area 102" and pharmaceutical product 104 stored therein. In this regard, a user may be able to look through the second window 138 to determine the amount of pharmaceutical product 104 remaining, the amount of pharmaceutical product 104 that has been dispensed, or both. Additionally, at least a portion of a dosing indicator 108" may be visible in the second window 138. The dosing indicator 108" may include a plurality of dosing segments. For instance and as seen in FIG. 3, a first dosing segment 148 and a second dosing segment 150 may be viewable in the second window 138. A portion of the third dosing segment 152 (i.e., not the entirety of the third dosing segment 152) is viewable in the first window 136.

The first dosing segment 148 may correspond to a morning dose of the first day of the dosing regimen. Accordingly, first segment information 160 may be provided to communicate this information to a user (e.g., "DAY 1 AM" as shown in FIG. 3). Furthermore, the first dosing segment 148 may include a first icon 162 (e.g., a checkmark in the illustrated embodiment) that indicates that the corresponding dose has been dispensed. The first icon 162 may be exposed to view when the first dosing segment 148 is moved from the first window 136 to the second window 138 in response to actuation of the actuator 106". As such, a dose corresponding to the first dosing segment 148 may be dispensed at the same time that the first dosing segment 148 is moved from the first window 136 to the second window 138 to reveal the first icon 162. In a similar regard, the second dosing segment 150 may correspond to an afternoon dose of the first day of the dosing regimen. Accordingly, second segment information 164 (e.g., "DAY 1 PM") may be provided to communicate this information to a user. Furthermore, the second dosing segment 150 may include a second icon 166 (e.g., a checkmark in the illustrated embodiment) that indicates that the corresponding dose has been dispensed. The second icon 166 may be exposed to view when the second dosing segment 150 is moved from the first window 136 to the second window 138 in response to the actuator 106" at the same time that a corresponding dose is dispensed from the dispenser 100".

In this regard, upon actuation of the actuator 106" the dosing indicator 108" may be sequentially advanced. A third dosing segment 152 may be partially displayed in the first window 136 prior to the actuation of the actuator 106" to dispense the dose corresponding to the third dosing segment 152. In this regard, third segment information 168 (e.g., "DAY 2 AM") provided on the third dosing segment 152 may be displayed in the first window 136. The dispenser 100" may include first dosing information 154 that may include textual information (e.g., "NEXT DOSE") indicating that the visible third segment information 168 in the first window 136 indicates when the next dose is due. That is, the third dosing segment 152 may be partially viewable in the first window 136 such that the third segment information 168 is aligned with the first dosing information 154. In that, as shown in FIG. 3, the dose corresponding to the third segment 168 has not yet been dispensed, a third icon (e.g., a checkmark) on the third dosing segment 108 may be blocked from view. As such, the first dosing information 154 may be provided adjacent to the first viewing window 136 explaining the third segment information 168 contained on the third dosing segment 152. For instance, the third dosing segment 152 may correspond to a morning dose of the second day of the dosing regimen. The alignment of the third dosing segment 152 with the first dosing information 154 may indicate that the next dose may be due in the morning of the second day of the dosing regimen.

Actuation of the actuator 106" may advance the dosing indicator 108" such that the third dosing segment 152 may become fully visible in the second window 138. In turn, the third icon (not shown, but at least generally in the form of the first and second icons 162 and 166 (e.g., a checkmark)) may become visible in the second window 138 to indicate the dose corresponding to the third dosing segment 152 was dispensed. Additionally, the next dosing segment may be advanced such that it is now partially visible in the first window 136 in a similar regard as the third dosing segment 152 is shown in FIG. 3. In addition to the first dosing information 154 ("NEXT DOSE"), second dosing information 155 may also be provided. Thus, dosing segments may be aligned with the first and second dosing information 154 and 155 to relay information to a user about the dosing status information. For instance, the first dosing information 154 may be prospective (e.g., "NEXT DOSE") and second dosing information 155 may be retrospective (e.g., "PREVIOUS DOSE" or "DOSES DISPENSED" as shown in FIG. 3). The second dosing information 155 may be provided on the dispenser 100" adjacent to the second window 138. In turn, the second dosing information 155 may correspond to the second window 138 such that dosing segments appearing in the second window 138 correspond to dispensed doses. In turn, a dosing segment in the position of the first dosing segment 148 or the second dosing segment 150 may be aligned with second dosing information 155 to provide further dosing schedule information.

Figure 4:
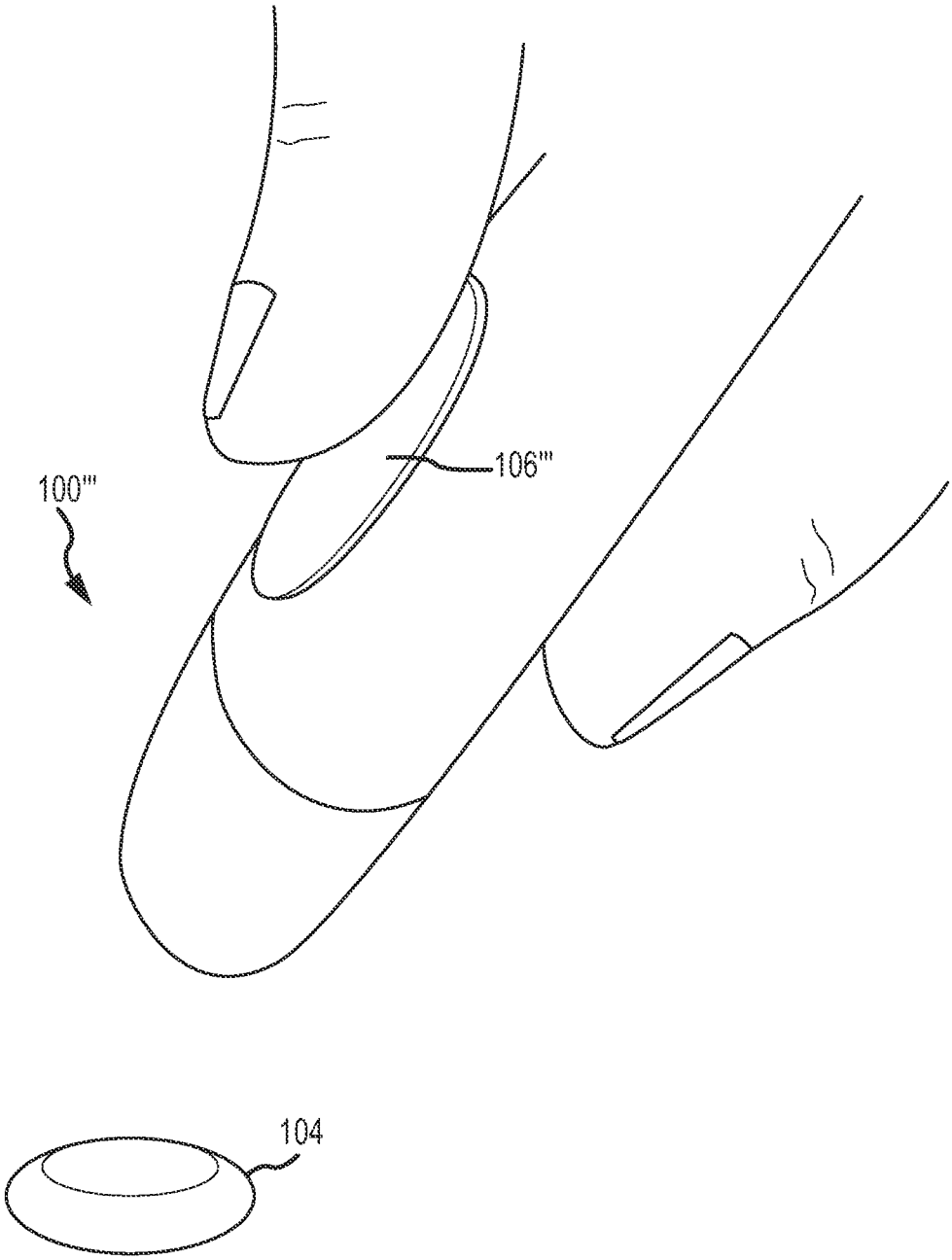
FIG. 4 is a perspective view of one potential variation for an embodiment of a pharmaceutical product dispenser, wherein an actuator is provided on a sidewall of the dispenser.

Another embodiment of a pharmaceutical product dispenser 100 is presented in FIG. 4 in the form of a pharmaceutical product dispenser 100'''. Corresponding components between the embodiments of FIGS. 1, 2, 3, and 4 are identified by the same reference numeral. Those corresponding components that differ in at least some respect from the embodiments of FIGS. 1, 2, and 3 are identified by a triple prime designation in FIG. 4. Unless otherwise noted herein, the discussion presented with regard to the embodiments of FIGS. 1, 2, and 3 remains equally applicable to the embodiment of FIG. 4 (including in relation to each of the individual components thereof).

The dispenser 100''' may include an actuator 106''' disposed on a side of the dispenser 100''' rather than on an end of the dispenser 100'''. Thus, actuation of the actuator 106''' may result in dispensing of pharmaceutical product 104 from the dispenser 100'''.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. A pharmaceutical product dispenser, comprising:

an elongated housing comprising a pharmaceutical product storage area located within an interior of said elongated housing, first dosing information on an exterior of said elongated housing, and second dosing information on said exterior of said elongated housing, wherein said elongated housing comprises first and second window segments that are spaced from one another, wherein said first dosing information is disposed adjacent to said first window segment, and wherein said second dosing information is disposed adjacent to said second window segment;

an actuator that interacts with said pharmaceutical product storage area and that is successively actuatable, wherein each actuation of said actuator is a movement of said actuator relative to said elongated housing to dispense a dose from said pharmaceutical product storage area; and a dosing indicator operatively interconnected with said actuator, wherein said dosing indicator comprises a plurality of dosing segments that each convey dose timing information, wherein adjacent dosing segments are sequentially advanced, by each actuation of said actuator where said actuator is moved relative to said elongated housing, into alignment with a respective one of said first dosing information and said second dosing information on said exterior of said elongated housing, and wherein different said dosing segments of said dosing indicator are simultaneously visible through said first and second window segments, respectively.

2. The pharmaceutical product dispenser of claim 1, further comprising:

an actuator lock, wherein an axial movement of said actuator is operable to dispense a dose from said pharmaceutical product storage area, wherein a rotational movement of said actuator changes said actuator lock between a locked configuration and an unlocked configuration in relation to said actuator, wherein when said actuator lock is in said locked configuration said actuator lock prevents actuation of said actuator, wherein when said actuator lock is in said unlocked configuration said actuator lock allows actuation of said actuator, wherein rotating said actuator from a first position to a second position and in a first direction disposes said actuator lock in said unlocked configuration, and wherein rotating said actuator from said first position to a third position in a second direction, opposite of said first direction, permanently disposes said actuator lock in said locked configuration.

3. The pharmaceutical product dispenser of claim 1, wherein said second window segment accommodates a visual indication of at least one of how many doses have been dispensed from said pharmaceutical product storage area and how many doses remain in said pharmaceutical product storage area.

4. The pharmaceutical product dispenser of claim 1, wherein said second window segment provides visual access to at least part of said pharmaceutical product storage area.

5. The pharmaceutical product dispenser of claim 1, wherein said second dosing information comprises textual information that conveys a last dose dispensed, and wherein said first dosing information comprises textual information that conveys a next dose to be dispensed.

6. The pharmaceutical product dispenser of claim 1, wherein each actuation of said actuator advances said dosing indicator one increment.

7. The pharmaceutical product dispenser of claim 1, wherein said dosing indicator provides a visual indication of a number of doses that have been dispensed from said pharmaceutical product dispenser.

8. The pharmaceutical product dispenser of claim 1, wherein said actuator is disposed on a first end of said elongated housing, wherein pharmaceutical product is dispensed from a second end of said elongated housing, and wherein said first and second ends are oppositely disposed.

9. The pharmaceutical product dispenser of claim 1, wherein each actuation of said actuator dispenses a single dose from said elongated housing.

10. The pharmaceutical product dispenser of claim 1, wherein said actuator is movable into a position where an actuator lock permanently locks said actuator.

11. The pharmaceutical product dispenser of claim 1, further comprising:

a dispenser lock; and an actuating mechanism that is spaced from said actuator and that is operatively interconnected with said dispenser lock.

12. The pharmaceutical product dispenser of claim 11, wherein said actuating mechanism for said dispenser lock and said actuator are positioned relative to one another so as to require one hand to interface with said actuating mechanism and another hand to interface with said actuator.

13. The pharmaceutical product dispenser of claim 11, wherein said actuating mechanism for said dispenser lock needs to be engaged in order to actuate said actuator.

14. The pharmaceutical product dispenser of claim 11, wherein said dispenser lock is operatively connected with a discharge opening cover.

15. The pharmaceutical product dispenser of claim 1, further comprising:

pharmaceutical product within said pharmaceutical product storage area.

16. The pharmaceutical product dispenser of claim 15, wherein individual doses of said pharmaceutical product are aligned in a row.

17. The pharmaceutical product dispenser of claim 1, wherein said second dosing information comprises textual information that conveys a last dose dispensed, and wherein said first dosing information comprises textual information that conveys a next dose to be dispensed.

18. The pharmaceutical product dispenser of claim 17, wherein each said dosing segment of said dosing indicator comprises an icon, wherein said icon for said dosing segment being displayed in said first window segment is blocked, and wherein said icon for each said dosing segment being displayed in said second window segment is visible.

19. The pharmaceutical product dispenser of claim 1, wherein each said dosing segment of said dosing indicator comprises an icon, wherein said icon for said dosing segment being displayed in said first window segment is blocked, and wherein said icon for each said dosing segment being displayed in said second window segment is visible.

20. A pharmaceutical product dispenser, comprising:

an elongated housing comprising a pharmaceutical product storage area, first dosing information, and second dosing information;

an actuator that interacts with said pharmaceutical product storage area;

an actuator lock, wherein an axial movement of said actuator is operable to dispense a dose from said pharmaceutical product storage area, wherein a rotational movement of said actuator changes said actuator lock between a locked configuration and an unlocked configuration in relation to said actuator, wherein when said actuator lock is in said locked configuration said actuator lock prevents actuation of said actuator, and wherein when said actuator lock is in said unlocked configuration said actuator lock allows actuation of said actuator; and a dosing indicator operatively interconnected with said actuator, wherein said dosing indicator comprises a plurality of dosing segments, and wherein adjacent dosing segments are sequentially advanced, by actuation of said actuator, into alignment with a respective one of said first dosing information and said second dosing information on said elongated housing.

21. The pharmaceutical product dispenser of claim 20, wherein rotating said actuator from a first position to a second position and in a first direction disposes said actuator lock in said unlocked configuration, and wherein rotating said actuator from said first position to a third position in a second direction, opposite of said first direction, permanently disposes said actuator lock in said locked configuration.

22. The pharmaceutical product dispenser of claim 20, wherein said elongated housing comprises a sidewall, wherein said sidewall comprises a window, and wherein at least part of said dosing indicator is visible through said window.

23. The pharmaceutical product dispenser of claim 22, wherein said window accommodates a visual indication of how many doses remain in said pharmaceutical product storage area.

24. The pharmaceutical product dispenser of claim 20, wherein each actuation of said actuator dispenses a single dose from said elongated housing, and wherein each actuation of said actuator advances said dosing indicator one increment.

25. The pharmaceutical product dispenser of claim 20, wherein said second dosing information comprises textual information that conveys a last dose dispensed, and wherein said first dosing information comprises textual information that conveys a next dose to be dispensed.

26. The pharmaceutical product dispenser of claim 20, further comprising:

a dispenser lock; and an actuating mechanism that is spaced from said actuator and that is operatively interconnected with said dispenser lock.

27. The pharmaceutical product dispenser of claim 20, further comprising:

pharmaceutical product within said pharmaceutical product storage area.

28. The pharmaceutical product dispenser of claim 20, wherein said elongated housing comprises first and second window segments that are spaced from one another, wherein different said dosing segments of said dosing indicator are simultaneously visible through said first and second window segments, respectively, wherein said first dosing information is disposed adjacent to the first window segment on an exterior of said elongated housing, and wherein said second dosing information is disposed adjacent to the second window segment on said exterior of said elongated housing.

29. The pharmaceutical product dispenser of claim 28, wherein each said dosing segment of said dosing indicator comprises an icon, wherein said icon for said dosing segment being displayed in said first window segment is blocked, and wherein said icon for each said dosing segment being displayed in said second window segment is visible.

30. The pharmaceutical product dispenser of claim 28, wherein said second dosing information comprises textual information that conveys a last dose dispensed, and wherein said first dosing information comprises textual information that conveys a next dose to be dispensed.

31. The pharmaceutical product dispenser of claim 30, wherein each said dosing segment of said dosing indicator comprises an icon, wherein said icon for said dosing segment being displayed in said first window segment is blocked, and wherein said icon for each said dosing segment being displayed in said second window segment is visible.

32. A pharmaceutical product dispenser, comprising:

an elongated housing comprising a pharmaceutical product storage area located within an interior of said elongated housing, first dosing information on an exterior of said elongated housing, and second dosing information on said exterior of said elongated housing;

an actuator that interacts with said pharmaceutical product storage area;

a dosing indicator operatively interconnected with said actuator, wherein said dosing indicator comprises a plurality of dosing segments that each convey dose timing information, and wherein adjacent dosing segments are sequentially advanced, by actuation of said actuator, into alignment with a respective one of said first dosing information and said second dosing information on said exterior of said elongated housing; and an actuator lock, wherein an axial movement of said actuator is operable to dispense a dose from said pharmaceutical product storage area, wherein a rotational movement of said actuator changes said actuator lock between a locked configuration and an unlocked configuration in relation to said actuator, wherein when said actuator lock is in said locked configuration said actuator lock prevents actuation of said actuator, wherein when said actuator lock is in said unlocked configuration said actuator lock allows actuation of said actuator, wherein rotating said actuator from a first position to a second position and in a first direction disposes said actuator lock in said unlocked configuration, and wherein rotating said actuator from said first position to a third position in a second direction, opposite of said first direction, permanently disposes said actuator lock in said locked configuration.

33. A pharmaceutical product dispenser, comprising:

an elongated housing comprising a pharmaceutical product storage area located within an interior of said elongated housing, first dosing information on an exterior of said elongated housing, and second dosing information on said exterior of said elongated housing, wherein said first dosing information conveys prospective dosing information, and wherein said second dosing information conveys retrospective dosing information;

an actuator that interacts with said pharmaceutical product storage area and that is movable relative to said elongated housing, wherein said elongated housing comprises first and second ends that are oppositely disposed from each other, wherein said actuator is moved in a direction of said second end to dispense from said pharmaceutical product storage area, and wherein said second dosing information is located between said first dosing information and said second end of said elongated housing; and a dosing indicator operatively interconnected with said actuator, wherein said dosing indicator is movable relative to each of said elongated housing, said first dosing information on said elongated housing, and said second dosing information on said elongated housing, wherein said dosing indicator comprises a plurality of dosing segments that move along with said dosing indicator relative to each of said elongated housing, said first dosing information on said elongated housing, and said second dosing information on said elongated housing, wherein each said dosing segment of said plurality of dosing segments conveys dose timing information, and wherein said dosing indicator is advanced relative to said elongated housing by actuation of said actuator to move one said dosing segment into alignment with said first dosing information and to simultaneously move an adjacent said dosing segment into alignment with said second dosing information.

34. The pharmaceutical product dispenser of claim 33, wherein each said dosing segment of said plurality of dosing segments comprises an icon, wherein said icon for said dosing segment being displayed in conjunction with said first dosing information is blocked, and wherein said icon for said dosing segment being displayed in conjunction with said second dosing information is visible.

35. The pharmaceutical product dispenser of claim 33, wherein each said dosing segment of said plurality of dosing segments that corresponds with a dispensed dose is visible.

* * * * *